United States Patent [19]

Castillo

[11] Patent Number: 4,614,338

[45] Date of Patent: Sep. 30, 1986

[54] HORIZONTAL FORCE EXERCISE APPARATUS

[76] Inventor: David D. Castillo, 3808 S. 14th St., Phoenix, Ariz. 85040

[21] Appl. No.: 665,716

[22] Filed: Oct. 29, 1984

[51] Int. Cl.[4] ..... A63B 21/06

[52] U.S. Cl. ..... 272/117; 272/118

[58] Field of Search ..... 272/117, 118, 134, 130, 272/DIG. 4, 93, 116, 136

[56] References Cited

U.S. PATENT DOCUMENTS

| | | | |
|---|---|---|---|
| D. 261,021 | 9/1981 | Lambert Sr. | D21/196 |
| 3,116,062 | 12/1963 | Zinkin | 272/118 |
| 3,756,595 | 9/1973 | Hague | 272/130 X |
| 3,768,808 | 10/1973 | Passera | 272/DIG. 4 X |
| 3,820,782 | 6/1974 | Salkeld | 272/118 |
| 3,917,262 | 11/1975 | Salkeld | 272/118 |
| 4,275,882 | 6/1981 | Grosser et al. | 272/130 X |

*Primary Examiner*—Richard J. Apley
*Assistant Examiner*—Robert W. Bahr
*Attorney, Agent, or Firm*—H. Gordon Shields

[57] ABSTRACT

Exercise apparatus for the lifting of weights includes horizontal movement of a bar, and the movement of the horizontal bar is connected through mechanical linkage to weights which are lifted vertically. The mechanical linkage is illustrated in different embodiments, including pivoting levers, a combination of pivoting levers and cables and pulleys, and gears connected with a cable and a pulley. Two sets of the apparatus may be linked together for joint movement, as for example doing vertical pushups, or the two sets may be used separately, as for doing alternate exercises in which the arms and hands are alternated in horizontal movement.

12 Claims, 15 Drawing Figures

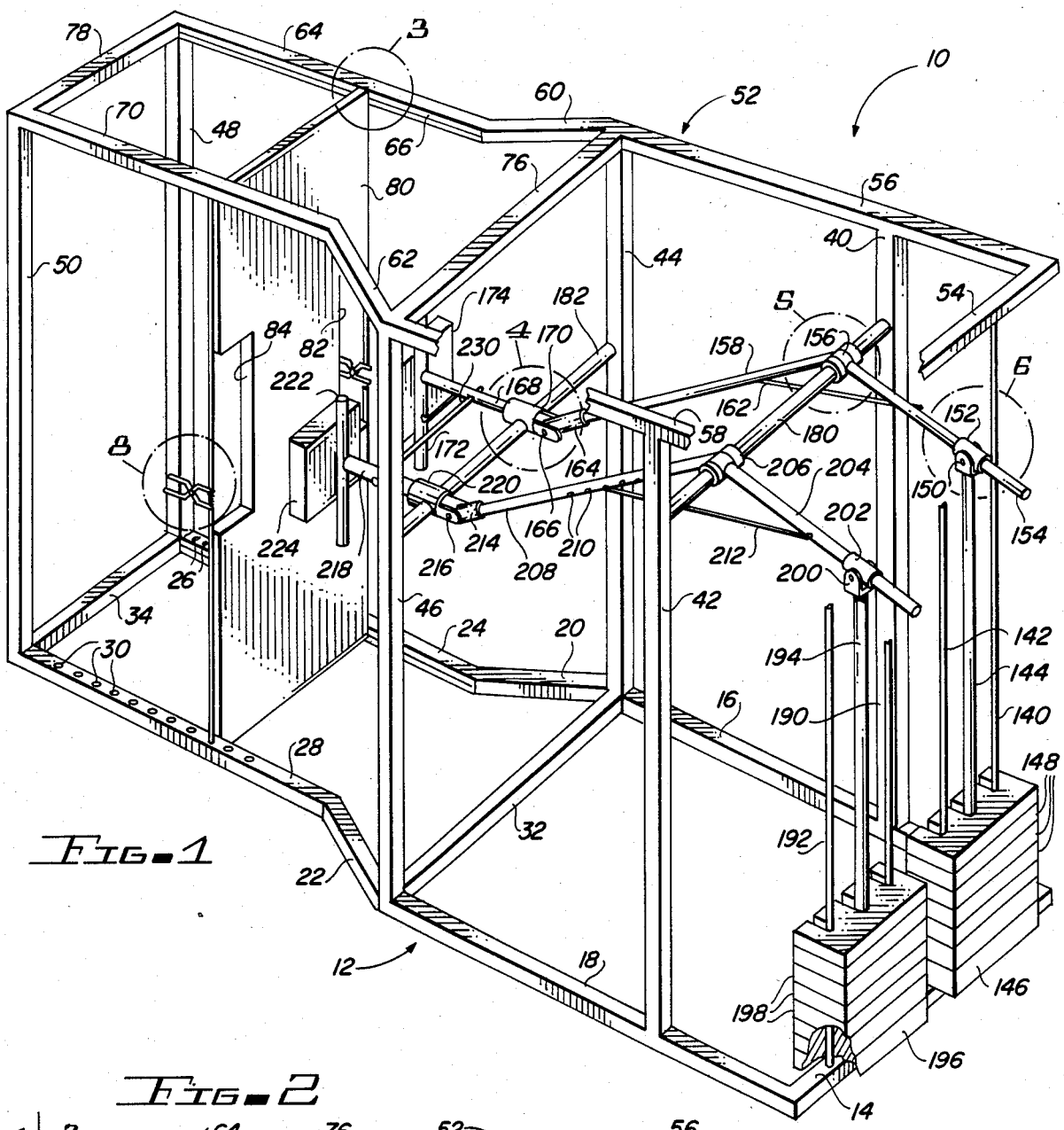
FIG. 1
FIG. 2
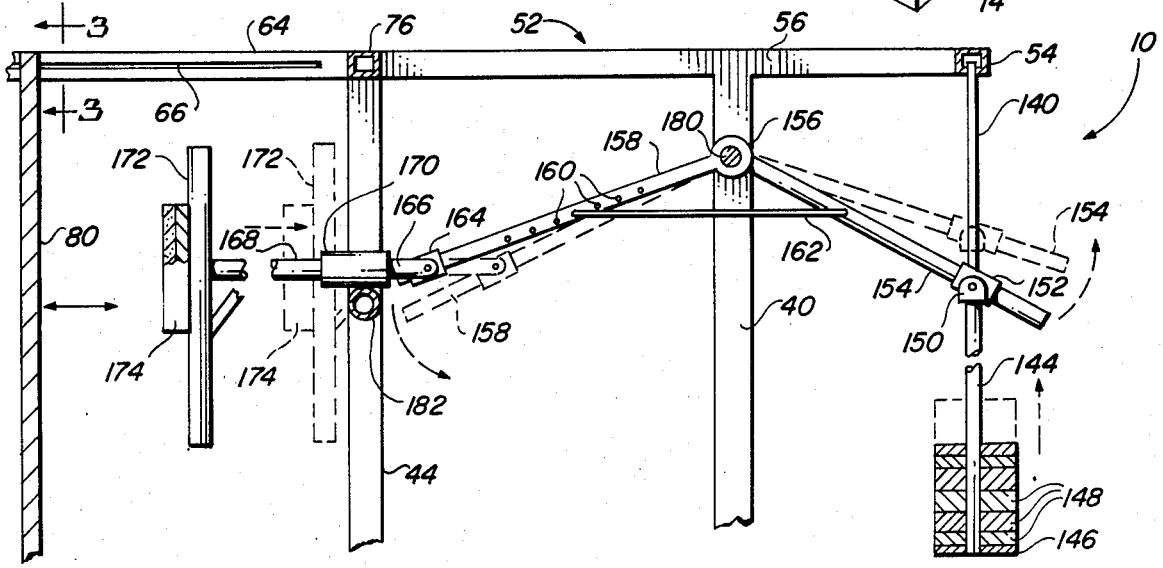

HORIZONTAL FORCE EXERCISE APPARATUS

BACKGROUND OF THE INVENTION

1. Field of the Invention:

This invention relates to exercise apparatus and, more particularly, to apparatus for exercising muscles using horizontal movements of the arms for lifting weights.

2. Description of the Prior Art:

U.S. Pat. No. 3,116,062 discloses a pivoting lever system for raising weights. The apparatus is designed particularly for leg presses. The user of the apparatus sits in a chair, with the user's feet disposed against foot receiving pedals. The extension of the legs causes the raising of weights through a pivoting lever system.

U.S. Pat. No. 3,614,097 discloses exercise apparatus which utilizes pulleys and cables to raise weights through a handlebar arrangement. The handlebar is pulled downwardly in order to raise the weights.

U.S. Pat. No. 4,275,882 discloses another handlebar type exercise apparatus. The handlebar is pivotally secured to a fixed frame and its movement is accordingly a pivoting movement. The pivoting handlebar lever may be secured to a hydraulic shock absorber or to a weight system, as desired.

U.S. Pat. No. 4,296,924 discloses a pulley and cable system for raising weights by means of a rotating capstan. A user is located in the center of a frame, and the weights are at opposite corners of the frame. Twisting motions of the user's torso are required to raise the weights through a cable and pulley system.

U.S. Pat. No. 4,357,010 discloses another pivoting handlebar system for raising weights through a plurality of pivoting levers. The handlebar pivots in the vertical plane.

U.S. Pat. No. 4,407,495 discloses another type of exercise apparatus utilizing a pivoted arm and a cable and pulley system for raising weights. The handlebar lever pivots in the vertical plane. The lever system includes two portions, one for leg exercises and the other for arm exercises.

U.S. Pat. No. 4,422,636 discloses another double handlebar system, one for the legs and one for the arms, both handlebar systems pivot in the vertical plane, and both systems are used for raising weights. The weights are disposed on a pivoting platform, and the handlebars are in turn connected to the platform.

It will be noted that with the exception of the '062 patent, all of the apparatus disclosed in the above-discussed patents includes exercise apparatus which pivots in the vertical plane. The '062 apparatus pivots in the horizontal plane, but is used for leg exercises. Thus, none of the apparatus disclosed in the above-discussed patents is adaptable for push-type exercises in the horizontal plane, as for exercising the arms and shoulders and for exercises comparable to pushups. The apparatus of the present invention is designed to allow a user to do pushups while standing in the vertical plane, or while sitting in the vertical plane, as in a rehabilitation situation for a bedridden patient.

SUMMARY OF THE INVENTION

The invention described and claimed herein comprises exercise apparatus for raising weights by horizontal movement through mechanical linkage, such as through sliding and pivoting linkage of solid members, pivoting linkage connected to weights by a cable system, or through the axial movement of a member connected to weights through a gear and cable system.

Among the objects of the present invention are the following:

To provide new and useful exercise apparatus;

To provide new and useful exercise apparatus usable from a vertical orientation of a user;

To provide new and useful apparatus for raising weights by horizontal movement;

To provide new and useful exercise apparatus for doing vertical pushups; and

To provide new and useful exercise apparatus adaptable to a bedridden patient for raising weights by horizontal movement.

BRIEF DESCRIPTION OF THE DRAWING

FIG. 1 is a perspective view of the apparatus of the present invention.

FIG. 2 is a side view of a portion of the apparatus of FIG. 1.

DESCRIPTION OF THE PREFERRED EMBODIMENT

FIG. 1 is a perspective view of horizontal exercise weightlifting apparatus 10 of the present invention. The weightlifting apparatus 10 is designed to exercise the upper extremities of the user by moving weights through the exertion of horizontal force. The force is exerted in the horizontal direction, and the horizontal movement is translated to vertical movement for raising and lowering weights.

The exercise apparatus 10 includes a bottom or base frame 12, a top or upper frame 52, and a plurality of vertically extending frame members which extend between the base frame 12 and the top frame 52. The base frame 12 and the top frame 52 each include a plurality of frame members. Movably secured to the frame of the apparatus 10 is a back rest 80. Also secured to the frame of the apparatus 10 are guide bars on which weights move. The weights move in response to force exerted in the horizontal direction or in the horizontal plane on a pair of pads.

FIG. 2 is a view in partial section through the frame of the apparatus 10, illustrating the vertical movement of weights in response to horizontal force movements.

Figure 3:
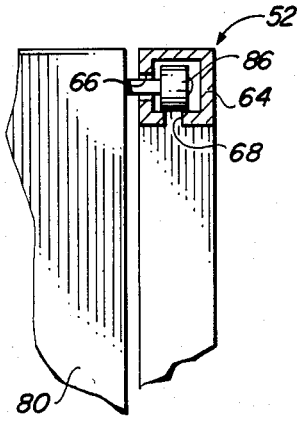
FIG. 3 is a view in partial section taken generally along line 3—3 of FIG. 2.
Figure 4:
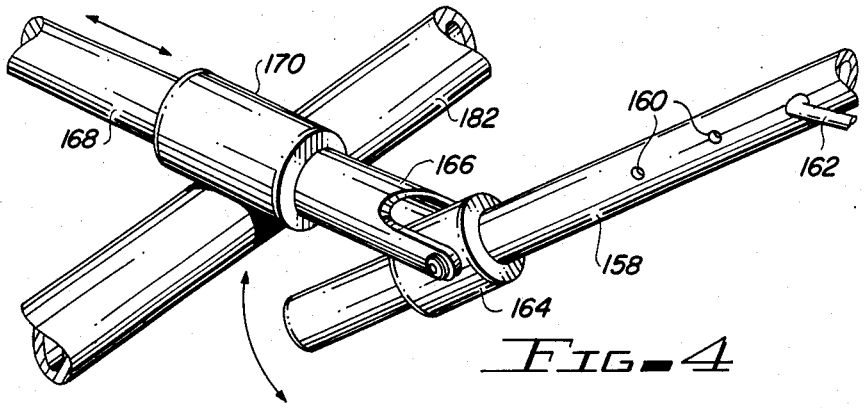
FIG. 4 is an enlarged view of a portion of the apparatus of the present invention taken generally from circle 4 of FIG. 1.
Figure 5:
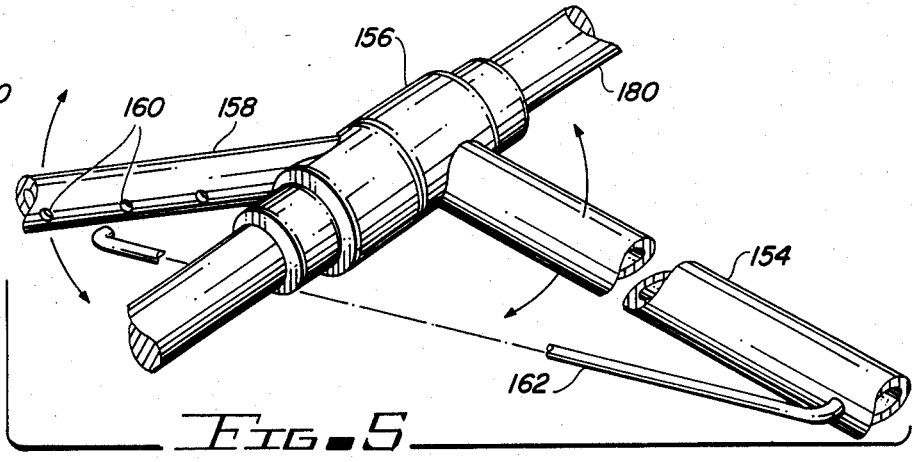
FIG. 5 is an enlarged view of a portion of the apparatus of the present invention taken generally from circle 5 of FIG. 1.
Figure 6:
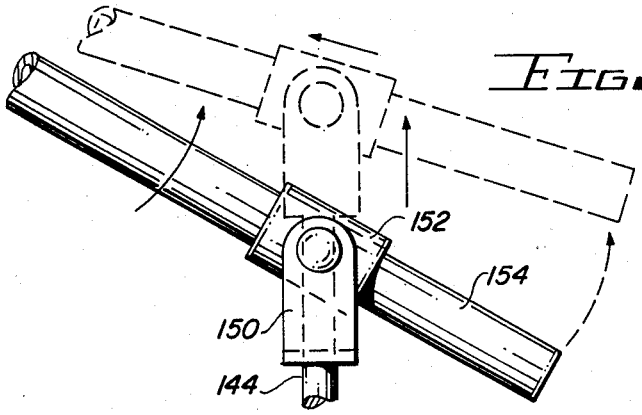
FIG. 6 is an enlarged view of a portion of the apparatus of the present invention taken generally from circle 6 of FIG. 1.

FIG. 3 is an enlarged view in partial section taken generally along line 3—3 of FIG. 2, illustrating the suspension of the back rest 80 on the upper frame 52. FIG. 4 is an enlarged perspective view of a portion of the apparatus 10 taken generally from circle 4 of FIG. 1, illustrating the interconnections and movement of some of the members of the apparatus 10 involved in the mechanical linkage translating horizontal movement to vertical movement through sliding and pivoting relationships of the members. FIG. 5 is an enlarged perspective view of another portion of the apparatus of the present invention taken in perspective generally from circle 5 of FIG. 1, illustrating the pivoting arrangement of some of the members of the apparatus 10. FIG. 6 is an enlarged view of another portion of the exercise apparatus 10 of the present invention, taken generally from circle 6 of FIG. 1, illustrating the sliding and pivoting movement of some members of the apparatus 10 being changed to vertical movement. FIGS. 3, 4, 5, and 6 illustrate the operation of specific elements or parts of the exercise apparatus 10 and their various relationships in translating horizontal movement to vertical movement.

Figure 7:
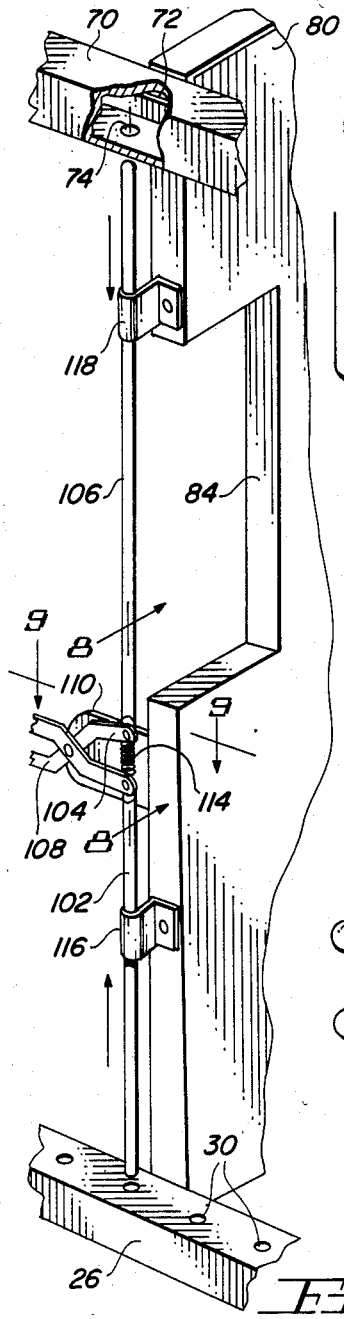
FIG. 7 is an enlarged view of a portion of the apparatus of the present invention taken generally from oval 7 of FIG. 1.
Figure 8:
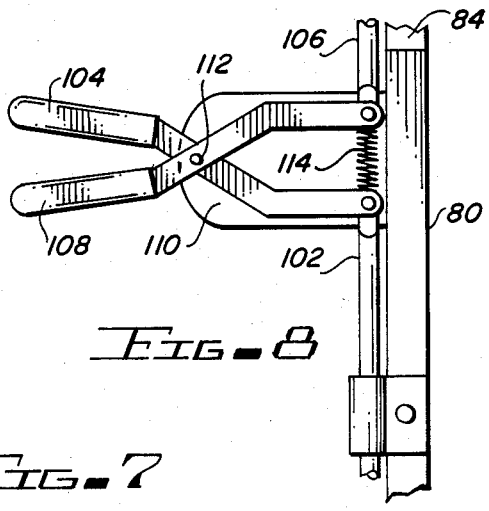
FIG. 8 is an enlarged view of a portion of the apparatus of the present invention taken generally along line 8—8 of FIG. 7.
Figure 9:
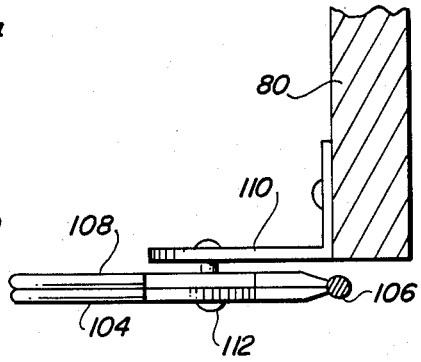
FIG. 9 is a view in partial section of a portion of the present invention taken generally along line 9—9 of FIG. 7.

FIG. 7 is an enlarged perspective view of a portion of the apparatus of the present invention, illustrating the locking in place of the back rest 80 on the lower and upper frames 12 and 52, respectively, of the exercise apparatus 10. FIG. 8 is an enlarged view of a portion of the apparatus shown in FIG. 7, taken generally along line 8—8 of FIG. 7, illustrating the vertical locking rods and levers associated with the locking and unlocking of the back rest 80. FIG. 9 is a view in partial section of the apparatus of FIG. 7, taken generally along line 9—9 of FIG. 7, illustrating the securing of the locking rods and levers to the back rest 80.

For the following discussion of the exercise apparatus 10, reference will generally be made to FIGS. 1–9.

The exercise apparatus 10 includes a frame within which a user stands. The user is generally braced against the movable back rest 80, and exerts force in the horizontal direction to raise weights secured to the frame.

The frame of the weightlifting or exercise apparatus 10 includes the base frame 12 and the top frame 52 secured together by a plurality of vertical frame members. The base frame 12 and the top frame 52, as well as the vertical frame members, are preferably made of square tubular elements for ease of construction. The various frame members are appropriately secured together, as by welding.

The base frame 12 includes a transversely extending front frame member 14, with a pair of front side frame members 16 and 18 extending rearwardly from the front frame member 14. Extending rearwardly and inwardly from the front side frame members 16 and 18 are a pair of connecting side frame members 20 and 22, respectively. Extending rearwardly from the connecting frame members 20 and 22 are a pair of rear side frame members 24 and 28, respectively. A plurality of apertures 26 and 30 extend downwardly through the top webs of the rear side frame members 24 and 26, respectively. The holes or apertures 28 and 30 are used in conjunction with the back rest 80, and will be discussed in detail below.

A mid-transverse frame member 32 extends between the rear portion of the front side frame members 16 and 18 at the juncture of the connecting side frame members 20 and 22.

At the back or rear of the base or bottom frame 12 is a transversely extending rear frame member 34. The frame member 34 extends between the rear side frame members 24 and 28, and is appropriately secured thereto.

The base frame 12 is shown having an irregular configuration, with the front portion being generally wider than the rear portion. The connecting side frame members 20 and 22 are used to reduce the general width of the base frame 12. Obviously, the bottom or base frame 12 may be of a regular, uniform width, if desired, or if appropriate.

Extending upwardly from the base frame 12 are a pair of front vertical frame members 40 and 42. The vertical frame members 40 an 42 are secured respectively to the front side frame members 16 and 18. A pair of central vertical frame members 44 and 46 extend upwardly from the juncture of the front side frame members 16 and 18 with the transverse frame member 32 and the connecting side frame members 20 and 22, respectively. A pair of rear vertical frame members 48 and 50 extend upwardly from the juncture of the rear side frame members 24 and 26 with the rear transverse frame member 32, respectively.

The top frame 52 is generally identical in configuration, and in frame members, to the base frame 12. The top frame 52 thus includes a front transverse frame member 54, with a pair of front side frame members 56 and 58 extending rearwardly from and appropriately connected to the top transverse frame member 54. The front frame member 54 is disposed generally parallel to the front frame member 14 of the base frame 12.

A pair of top connecting side frame members 60 and 62 extend rearwardly and inwardly from the top frame members 56 and 58, respectively, and are disposed substantially parallel to the connecting frame members 20 and 22, respectively, of the base frame 12. Extending rearwardly from the connecting frame members 60 and 62 are a pair of rear side frame members 6 and 70. The rear side frame members 66 and 70 are generally parallel to the bottom frame members 24 and 28, respectively.

A central cross or transverse frame member 76 extends between, and is appropriately secured to, the junctures of the top frame members 56, 60 and 58, 62 and at the juncture of the vertical frame members 44 and 46, respectively. A rear cross or transverse frame member 78 is secured to, and extends between, the rear frame members 64 and 70 at the juncture of the vertically extending frame members 48 and 50, respectively. The frame member 76 is generally parallel to the frame member 32, and the frame member 78 is generally parallel to the frame member 34.

As shown in FIGS. 1, 2, 3, and 7, the rear side frame members 64 and 70 of the top frame 52 include longitudinally extending slots in their side webs in which the back rest 80 is supported and in which it moves. The rear side frame member 64 includes a slot 66 in its inside web, and the rear side frame member 70 includes a longitudinally extending slot 72 in its inside web.

Extending through the bottom webs of the side frame members 64 and 70 are a plurality of apertures. One of the apertures, an aperture 74, in the bottom web of the rear side frame member 70, is shown in FIG. 7. The apertures in the top rear side frame members 64 and 70 are aligned with the apertures 26 and 30 in the rear side frame members 24 and 28 for the purpose of locking the back rest 80 in place. This will be discussed in detail below, primarily in conjunction with FIGS. 7, 8, and 9.

The back rest 80 is disposed at the rear portion of the apparatus 10, and between the rear side members of the base frame and the top frame. The back rest 80 includes two side cutout portions, including a side cutout portion 82 and a side cutout portion 84. The purpose of the side cutouts 82 and 84 is to receive a user's elbows and arms while exercising. The overall length or height of the cutouts 82 and 84 is of a sufficient size to accommodate users of various heights.

As shown in FIG. 3, the back rest 80 includes a roller assembly which extends from the back rest 80 into the interior of the frame member 64. The roller assembly includes an axle which extends through the slot 66, and a roller which is disposed within the frame member 64. The opposite side of the back rest 80 is substantially identically disposed with respect to the upper frame member 70 and the slot 72 in its side web. The back rest 80 accordingly is suspended from, and moves on, the frame members 64 and 70 of the top or upper frame 52 through roller assemblies secured to the back rest.

An aperture 68, extending through the bottom web of the frame member 64, is shown in FIG. 3. The aperture 68 is one of a plurality of spaced apart apertures used to lock the back rest 80 in place. The aperture 68 of the frame member 64, and the aperture 74 of the frame member 70 (see FIG. 7) are aligned with the apertures 26 and 30 in the bottom frame members 24 and 28, respectively.

To accommodate users of various heights and arm lengths, the back rest 80 is movably disposed on the frame and is locked in place by a plurality of locking rods. The outer ends, both upper and lower ends, of the locking rods extend into the apertures in the frame members. The apertures 26 in the side frame member 24 of the bottom frame 12 are shown in FIG. 1, while the apertures 30 in the side frame member 28 of the bottom or base frame 12 are shown in both FIGS. 1 and 7. An aperture 68 in the side frame member 64 of the top frame 52 is shown in FIG. 3, and an aperture 74 in the frame member 70 of the top frame 52 is shown in FIG. 7.

The locking rod assembly for locking the back rest 80 in place includes a pair of rods on each side of the back rest. Each pair of rods includes an upper rod and a lower rod. As best shown in FIG. 7, a lower lock rod 102 and an upper lock rod 106 are secured to one side of the back rest 80 through a pair of guide elements, including a lower guide element 116 and an upper guide element 118, for the lower guide rod 102 and the upper guide rod 106, respectively. The lower guide rod 102 moves vertically and, when it is down, locked in place, it extends into one of the apertures 30 in the side frame member 28. The upper lock rod 106 is locked in place upwardly within one of the apertures or holes 74 in the side frame member 70. The guide rod pairs are preferably offset slightly from the roller suspension assemblies secured to the top of the back rest 80 so as not to interfere with the rollers in the upper rear side frame members.

At the upper and lower ends of the lock rods 102 and 106, respectively, are levers 104 and 108. The levers 104 and 108 are pinned together and secured by a bracket 110 to the back rest 80. The levers are secured together at the bracket 110 by a pivot pin 112. This is shown in FIGS. 7, 8, and 9. A compression spring 114 is disposed between the ends of the rods 102 and 106 at their levers 104 and 108, respectively. The purpose of the compression spring 114 is to bias the lock rods 102 and 106 downwardly and upwardly, respectively, into their respective apertures 30 and 74, to secure the back rest 80 in place. The levers 104 and 108 preferably extend outwardly or rearwardly from the back rest 80, and accordingly outwardly or rearwardly from the frame of the exercise apparatus 10. The reason for the outward or rearwardly disposition of the levers is to minimize the likelihood or possibility of interference between the user's arms and the levers.

When the outer, free ends of the levers are squeezed together by a user, the levers pivot on the pin 112, which is fixed in place on the bracket 110, and the levers 102 and 106 are drawn upwardly and downwardly, respectively, or outwardly from their frame members, and against the bias of the compression spring 114. The lock rods, when free of the frame members, release the back rest 80 and allow it to move on the upper frame members so that it may be positioned as desired by the user of the apparatus.

As may be understood from FIG. 7, there is a clearance or space between the roller assemblies at the top of the back rest 80 and the adjacent lock rods so that there is no interference between the lock rods and the roller assemblies.

A similar pair of lock rods, with the accompanying guides, levers, and bracket, are disposed at the opposite side of the back rest 80. Their outer ends cooperate with the holes or apertures 26 and 68 in the frame members 24 and 64, respectively, to secure the opposite side of the back rest 80 to the frame. The levers connected with the lock rods are, of course, similarly extending outwardly or rearwardly.

It will be understood that the overall width of the back rest 80 is appropriately dimensioned so that a user may easily grasp the levers on the opposite sides of the back rest to simultaneously release the lock rods on both sides in order to move the back rest and to position it as desired. Moreover, the lever assemblies are secured to the back rest 80 beneath the respective cutouts, which also minimizes the likelihood of interference between the user and the levers.

As best shown in FIG. 8, the levers 104 and 108 are configured and pinned in a scissors-like arrangement, so that the squeezing of the handles of the levers results in a similar or comparable movement of the ends of the levers secured, as by pins, to the rods 102 and 106, respectively.

The lower and upper locking rods, on both sides of the back rest 80, are of sufficient size to easily withstand the force applied in opposition to the user of the apparatus. The guides for the locking rods, such as the lower guide 116 for the rod 102 and the upper guide 118 for the upper locking rod 106, respectively, are of sufficient length and strength to also provide the necessary strength for the back rest 80 and the locking rods to prevent inadvertent movement or breakage of the apparatus in use. If required, there may be more than one such guide for each locking rod, depending on the strength requirements of the apparatus, etc.

At the front of the framework of the exercise apparatus 10 are two pairs of guide bars or rods which extend between the front transverse or cross frame member 14 of the base or lower frame 12 and the parallel front transverse frame member 54 of the top or upper frame 52. The pairs of guide bars include a pair of guide bars 140 and 142 and a pair of guide bars 190 and 192. Between the guide bars or rods 140 and 142 is a weight rod or weight bar 144. Between the guide rods 190 and 192 is a weight bar or weight rod 194. At the bottom of the weight rod or bar 144 is a fixed weight rod 194. At the bottom of the weight rod or bar 144 is a fixed weight 146. At the bottom of the weight rod or bar 194 is a fixed bottom weight 196. The fixed bottom weights 146 and 196 comprise platforms on which additional weights may be placed. A plurality of weights 148 are stacked on top of the fixed bottom weight 146, and a plurality of weights 198 are stacked on the bottom fixed weight 196. The weights 148 and 198 may, of course, be added to or taken from, the base or fixed weights in accordance with the user of the exercise apparatus 10.

The upper end of the weight bar 144, remote from the bottom fixed weight 146, terminates in a yoke 150. A sleeve 152 is pivotally secured to the yoke 150. A rod 154 extends through the sleeve 152. The rod 152 is secured through a double bearing pivoting element 156 to another rod 158. Both rods 154 and 158 are pivotable relative to each other through the element 156.

The bearing element 156 includes two portions, a portion which is directly secured to the rod 154 and a portion which is secured to the rod 158. Both rods 154 and 158 pivot together, but they are adjustable relative to each other by means of a lock rod 162 and a plurality of apertures 160. The plurality of apertures 160 are found in the rod 158. The lock rod 162 is pivotally secured to the rod 154. The distal end of the rod 162, remote from the rod 154, is adjustable into any of the apertures or holes 160. The enclosed angle between the rods 154 and 158 is accordingly adjustable by means of the lock rod 162. With the rod 162 locking the rods 154 and 158 together, the rods 158 and 154 pivot as a unit.

The free end of the rod 158, remote from the pivot element 156, extends through a sleeve 164. The sleeve 164 in turn is pivotally secured through a yoke 166 to a rod 168. The rod 168 extends through a sleeve 170 adjacent to the yoke 166.

At the distal end of the rod 168, remote from the yoke 166 and from the sleeve 170, is a vertically extending bar 172. The bar 172 is appropriately secured to the rod 168. As shown, a diagonal brace may be required to secure the bar 172 to the rod 168. A pad 174 is adjustably secured to the vertical bar 172. The pad 174 is adapted to be used for pushing, as by hand, during exercises. For pulling exercises, the bar 172 may be grasped directly by a user's hand.

There are a pair of cross rods or cross rod members to which the pivoting element 156 and the sleeve 170 are secured. A front cross rod member 180 extends between, and is appropriately secured to, the vertical frame members 40 and 42. A rear cross rod member 182 extends between, and is appropriately secured to, the vertical frame members 44 and 46. The sleeve 170 is preferably fixedly secured to the cross member 182, while the pivoting sleeve element 156 is pivotally secured to the cross rod 180.

A horizontal force applied to the pad 174 and through the vertical bar 172 to the horizontally extending rod 168 causes a forward movement of the rod 168 with respect to the sleeve 170. That is, the rod 168 moves through the sleeve 170. The yoke 166, secured to the rod 168, in turn causes a forward movement of the sleeve 164 which is pivotally secured to the yoke 160. The rod 158, which extends through the sleeve 164, pivots on the rod 180 through its pivoting sleeve element 156.

As the rod 168 moves forward, the rod 158 moves through the sleeve 164 and pivots on the rod 180. Since the rod 158 is secured to the rod 154 through the lock rod 162, a pivoting movement of the rod 158, in a downward direction, causes a corresponding pivoting movement, but in the upward direction, of the rod 154. This is shown in FIG. 2. The rod 154 pivots upwardly on the cross rod 180 and causes the weight rod 144 to move upwardly. The pivoting movement of the rod 154, counterclockwise as viewed in FIGS. 1 and 2, causes the weight rod 144 to move upwardly.

The rod 154, at its free end, moves through the sleeve 152, as it moves upwardly. The sleeve 152 pivots on the yoke 150 as the rod 154 moves upwardly. The weights 146 and 148 move upwardly with the rod 144, thus providing the weightlifting exercise for the user of the apparatus.

As shown in FIGS. 1 and 2, the pad 174 and the weights 146 and 148 are adapted to provide exercise for the left arm and the left upper extremity muscles of the user. The right arm of the user, and the user's right upper extremity muscles are similarly exercised by the raising of the weight bar 194 and the weights 196 and 198 on the guide rods 190 and 192.

The weight bar 194 is secured to a rod 204 through a yoke 200 and a sleeve 202. The yoke 200 is secured to the upper end of the weight bar 194. The sleeve 202 is in turn pivotally secured to the sleeve 200.

Thr rod 204 is secured through a pivoting sleeve element 206 to a rod 208. The element 206, which is substantially identical to the element 156, is similarly pivotally secured to the cross member 180. The rod 208 includes a plurality of holes or apertures 210 which receive one end of a lock rod 212. The other end of the lock rod 212 is appropriately secured to the rod 204. The location at which the free end of the rod 212 is secured in one of the apertures 210 determines or fixes the enclosed angle between the rods 204 and 208. The particular significance of the angle will be discussed below.

The free end of the rod 208, remote from the pivoting sleeve element 206, extends through a sleeve 214. The sleeve 214 is pivotally secured through a yoke 216 to a horizontally extending rod 218. The rod 218 extends through a sleeve 220 which is fixed to the rear cross member or rod 182. The horizontally extending rod 218 is in turn secured to a vertically extending bar 222. A pad 224 is movably adjustable on the vertical bar 222. The bar 222 is appropriately secured to the rod 218.

As best shown in FIG. 4, a horizontal movement of the horizontally extending rod 168 causes a pivoting movement of the rod 158 through the sleeve 164 and the yoke 166. The yoke 166 is secured to the distal end of the rod 168, remote from the pad 174. The pivoting arrangement between the sleeve 164 and the yoke 166 allows the movement of the rod 168 to be horizontally linear and converts the horizontal movement of the rod 168 to a pivoting movement of the rod 158.

With the lock rod 162 securing the rods 154 and 158 together into a fixed or unitary element, a counterclockwise pivoting movement of the rod 158 is translated, by a corresponding counterclockwise pivoting movement of the rod 154, into a vertically upward movement of the weight bar 144. This is shown sequentially best in FIGS. 5 and 6. The securing together of the rods 154 and 158 through the pivoting sleeve element 156 on the fixed cross rod 180 is shown in FIG. 5. In FIG. 6, the counterclockwise pivoting of the rod 154 is shown causing a vertically upwardly movement of the weight rod 154. The yoke 150, secured to the upper end of the rod or bar 144, moves upwardly in response to the pivoting movement of the rod 154. The rod 154 pivots and moves through the sleeve 152. The sleeve 152 pivots freely on the yoke 150, and in turn causes the bar 144 to move upwardly, carrying with it the bottom fixed weight 146 and the movable weights 148.

The primary purpose of the lock rods 162 and 212 and the apertures 160 and 210 is to adjust the distance, vertically upwardly, through which the weights may be raised. The adjustment of the lock rods 162 and 212 causes the enclosed angle between the bars 154, 158 and 204, 208 respectively, to be varied. It is obvious that by decreasing the enclosed angle, the pads 174 and 224 move closer to the transversely extending bar 182, thus shortening the overall length of the stroke or movement of the horizontally extending rods 168 and 218. Conversely, by increasing the enclosed angle, the overall length of the stroke or movement of the horizontally extending rods 168 and 218 is increased. This may also be visualized by reference to FIG. 2. FIG. 2 also illustrates the overall movement of the weight rod 144, with its fixed weight 146 and its variable weights 148. The inward movement of the pad 174 and the rod 168, and the resulting pivoting movement of the rods 158 and 154, and the upward movement of the weights is shown in phantom in FIG. 2.

In FIG. 1 is shown a transversely extending cross pin 230. The pin 230 is secured to the horizontally extending rods 168 and 218. The cross pin 230 may be used to lock the rods 168 and 218 together for joint movement. Thus, for example, a user standing against the back rest 80, applies one hand to the pad 174 and one hand to the pad 224. A horizontally forward movement by the user results in a horizontally forward movement of the pads 174 and 224 and of their respective rods 168 and 218. The movement of the pads 174 and 224 and of the rods 168 and 218, secured together by the pin 230, is accordingly a joint or simultaneous movement. There is, of course, a corresponding simultaneous pivoting movement of the rods 158, 154, and 208, 204, and a similar, corresponding upward movement of the weight bars 144 and 194 and of their respective weights.

By removing the cross pin 230, a user, instead of performing simultaneous exercise or arm movements, may exercise the arms and upper extremity muscles alternately, if desired. The apparatus may thus be used to exercise upper extremity muscles simultaneously or alternately, as desired. Obviously, simultaneous movement and exercise may also be accomplished with the pin 230 removed. However, such simultaneous movement is movably not as effective as with the pin 230 in place.

It is obvious that a forward movement of the pads 174 and 224, and of the rods 168 and 218, and of the other rods secured through the mechanical linkage arrangement discussed, causes an upward movement of the weights. It will be understood that gravity will cause the weights to move downwardly, without a corresponding exertion by the user. However, if the user does not cushion the downward movement, again by muscle power, which is the reverse of the horizontally forward movement, the weights will move downwardly rather rapidly. Thus an expenditure of energy is required for raising the weights and for lowering the weights, or for allowing the weights to be lowered. However, obviously a greater expenditure of energy or exertion is required to raise the weights than to merely slow down the downward movement of the weights.

It will be obvious that a number of different types of exercises may be accomplished by the apparatus of the present invention, including standing or upright push-ups, horizontal presses, etc.

Figure 10:
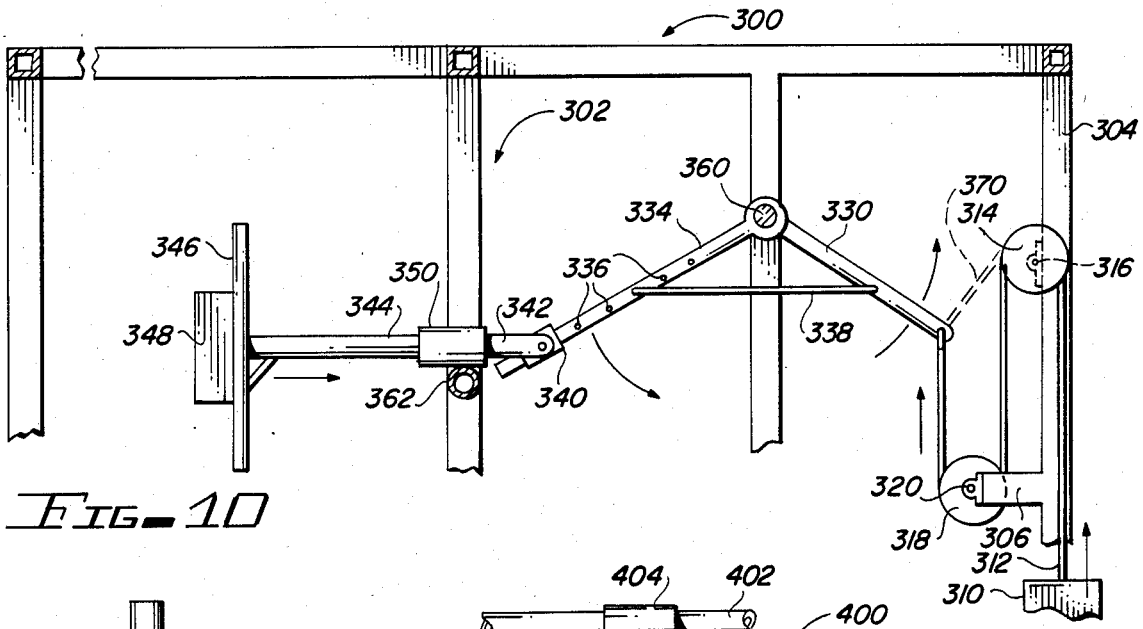
FIG. 10 is a side view of a portion of an alternate embodiment of the apparatus of the present invention.

FIG. 10 is a side view of an alternate embodiment of the apparatus 10 of FIGS. 1–9. The apparatus 300 is substantially identical to the apparatus 10 except for the weight raising elements. A frame 302 is utilized, which includes a lower or base frame (not shown), an upper frame, and the upper and lower frames are connected by a plurality of vertically extending frame members. The frame 302 is substantially identical to the frame of the apparatus 10 of FIGS. 1–9.

At the front of the frame 302 is a vertically extending frame member 304. The front vertical frame member 304 is used in conjunction with a pair of pulleys 314 and 318 to cause vertical movement of weights 310. The weights 310 are secured to a cable 312 which extends over the pulley 314 and beneath the pulley 318. The pulleys 314 and 318 are secured to the vertical frame member 304 through a rod or shaft 316 and a rod or shaft 320. The rod or shaft 316 is appropriately secured to the vertical frame member 304, and the rod or shaft 318 is secured to a stub frame member 306, which is in turn secured to the vertical frame member 304. The pulleys 314 and 318 are, of course, appropriately journaled for rotation on the shafts 316 and 320 respectively.

The end of the cable 312, remote from the weights 310, is secured to the free end of a pivoting rod 330. The rod 330 is appropriately secured through a pivoting sleeve element 332 to a rod 334. The pivoting sleeve 332 is in turn secured for pivoting movement on a transversely extending cross rod 360. The rod 334 includes a plurality of apertures 336 which receive the free end of a lock rod 338. The opposite end of the lock rod 338 is appropriately secured to the pivoting rod 330.

The rod 334 extends through a sleeve 340 which is pivotally secured to a yoke 342. The yoke 342 is in turn secured to one end of a horizontally extending rod 344. The rod 344 moves horizontally through a sleeve 350. The sleeve 350 is in turn secured to a transversely extending rod 362.

The end of the rod 344, remote from the yoke 342, is appropriately secured to a vertical bar or rod 346. A pad 348 is adjustably secured to the rod or bar 346. That is, the pad 348 may be positioned vertically, as desired, on the rod or bar 346. The arrangement of the pad 348, the bar 346, the rods 344, 334, and 330 is substantially identical to the corresponding elements in the apparatus 10. However, the employment of the pulleys and cable is different from the employment of the weight bars 144 and 194, and their respective yokes and pivoting sleeves. The horizontal movement of the pad 348 and the rod 344, and the accompanying pivoting movement of the rods 334 and 330 have the same effect with respect to the raising and lowering of the weights 310 as with the raising and lowering of the weights of the apparatus 10. Thus, a horizontal forward or inward movement of the pad 348 and of the rod 344 results in a counterclockwise pivoting of the rod 334 and of the rod 330, which rods 334 and 330 are fixed together by the lock rod 338. As the rod 344 moves forwardly or inwardly, the rod 334 pivots as it moves through the sleeve 340. The pivoting of the rod 334 is accompanied by a corresponding pivoting of the rod 330. Movement of the rod 330 and of the rod 334 in a counterclockwise direction, shown in FIG. 10 by curved arrows, around the pivot axis on the transverse rod 360 causes the outer end of the rod 330 to move upwardly. As the outer or free end of the rod 330 moves upwardly, the cable 312 moves upwardly, and there is a corresponding movement of the weights 310.

It will be noted that the purpose of the pulleys 314 and 318 is to cause the appropriate upward and downward movement of the weights 310 in response to the pivoting movement of the rod 330.

As has been discussed in conjunction with the apparatus 10, an inward or forward movement of the pads and the horizontal rods causes an upward movement of the weights. This movement requires a substantial amount of energy, and thus a user derives the primary exercise benefit. This inward movement of the bars and the raising of the weights is a result of a pushing movement by the hands and arms of a user. By utilizing the pulley system of exercise apparatus 300, but changing to a single pulley arrangement, rather than a dual pulley arrangement, and by locating the pulley above the outer or free end of the rod 330, the apparatus 300 may be used for a pull-type exercise. The pulley 314 is shown in phantom in FIG. 10 disposed above the free end of the rod 330. The cable 314 is shown in phantom at 370 extending directly from the rod 330 to and over the pulley 314.

With the cable 312 extending from the weights 310 upwardly and over the pulley 314, and then downwardly to the free end of the rod 330, the direction of force on the rods 330, 334 and 344 is changed. The pull of gravity on the weights 310 causes the outer or distal end of the rod 330 to move counterclockwise, and thus to move upwardly. This in turn causes a corresponding pivotal movement of the rod 334, and in turn the rod 344 will move horizontally outwardly to a rest position. To raise the weights 310, a pull will then be required on the bar 346. To accomplish such pull, a user will grasp the bar or rod 346 by hand, and will exert a pulling force on the bar 346 which will in turn be translated to the cable 312 through the rods 344, 334, and 330, and then through the cable 312.

By utilizing a pulley and cable arrangement, the exercise apparatus 300 may be used for both push exercises and pull exercises. Obviously, the apparatus 300 may be a dual or double system, like the apparatus 10. However, only half of the apparatus is shown in FIG. 10.

Figure 11:
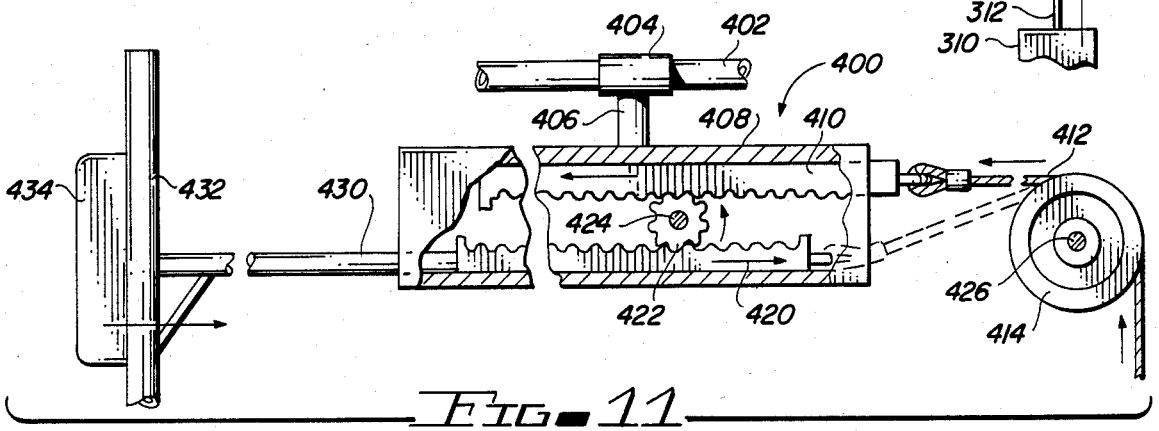
FIG. 11 is a side view of a portion of another alternate embodiment of the apparatus of the present invention.

FIG. 11 is a side view, in partial section, of exercise apparatus 400, which is an alternate embodiment of the apparatus of the present invention. The apparatus 400 comprises a horizontally linear exercise apparatus adapted particularly for rehabilitative uses, as for use by patients in hospitals or other patients or persons confined to beds. The apparatus 400 utilizes a pinion gear fixed to a housing and disposed between a pair of horizontally movable racks. The rack and pinion arrangement translates the horizontal movement of the racks through a cable and pulley system to the vertical movement of the weights.

The apparatus 400 includes a longitudinally extending frame member 402, which may be part of a frame disposed above a hospital bed, and which is typically used for supporting various types of exercise apparatus for a bed-ridden patient. Supported on the frame member 402 is a sleeve 404. The sleeve 404 is longitudinally adjustable on the frame member 402 for moving the exercise apparatus 400 in order to position it as desired with respect to a patient. The sleeve 400 is then locked in place on the frame member 402. Extending downwardly from the sleeve 404 is a frame member 406. The frame member 406 is in turn secured to a housing 408.

Within the housing 408 are a pair of racks, including a top rack 410 and a bottom rack 420. A pinion gear 422 is disposed between the racks. The racks are longitudinally movable in the housing 408. The pinion 422 is rotatably secured to the housing 408.

A cable 412 is appropriately secured to one end, defined as the outer end, of the top rack 410. The cable 412 extends to and over a pulley 414. The pulley 414 is appropriately journaled for rotation on a shaft 426. The shaft 426 is secured to a fixed frame such as the frame of which the frame member 402 is a part, and is preferably located beyond the foot of the bed in which a user of the apparatus 400 is disposed. The distal end of the cable 412, remote from the rack 410, is secured to a weight (not shown).

The pinion gear 422 is journaled for rotation on a shaft 424. The shaft 424 is secured to the housing 408. The pinion 422 rotates on its shaft 424 in response to movement of one of the racks 420 or 410 in the horizontal direction. The movement of one rack is in turn translated through the pinion 422 into movement of the opposite rack. The racks, of course, move in opposite directions substantially simultaneously.

The lower rack 420 is secured to a rod 430. The rod 430 extends outwardly from the housing 408 generally oppositely from the cable 412. At the end of the rod 430, remote from the housing 408, is a vertically extending rod or bar 432. A pad 434 is movably secured, or adjustably secured, to the rod or bar 432. The pad 434 is designed to be moved vertically on the rod 432 to adjust the position or height of the pad 434 for the convenience of the user of the apparatus.

In using the exercise apparatus 400, the housing 408 is positioned on the frame 402 adjacent to a user, which would typically be a bedridden patient. The patient/user of the exercise apparatus 400 places a hand either on the pad 434 or directly on the vertical bar 432. The bar 432, with or without the pad 434, comprises a handle, and it may be grasped directly, if desired. Force is applied in a horizontal direction through either the pad 434 or the handle 432. The force is then applied through the rod 430 to the rack 420. Movement of the rack 420 in the direction shown by the heavy arrow on the rack 420, which is to the right in FIG. 11, causes a counterclockwise movement of the pinion 422. This is also shown by a heavy arrow by the pinion gear in FIG. 11. Movement of the pinion 422, as it meshes with the rack 410, causes movement of the rack 410 in the opposite direction to the movement of the rack 420. This is shown by a heavy arrow on the rack 410. This movement of the rack 410, to the left in FIG. 11, causes the cable 412 to also move to the left, thus raising a weight (not shown) secured to the opposite or free end of the cable 412.

As the user decreases or terminates the force on the pad 34 or the handle bar 432, movement of the racks will reverse due to the weight pulling on the rack 410 by reason of gravity. The reverse movement of the rack 410 results in a reverse movement of the pinion 422 and of a corresponding reverse movement of the rack 420. The rate of movement of the racks in both directions, and thus of the weight, depends, of course, on the user of the apparatus.

For reversing the exercise regimen, thus requiring that the force applied through the handle 432 is a pulling force rather than a pushing force, the cable 412 may be secured to the outer or distal end of the rack 420, remote from the rod 430 and the rod or handle 432 and the pad 434. This is shown in phantom in FIG. 11. With the cable 412 applied directly to the end of the rack 420, the weight on the end of the cable 412 will be applied directly to the end of the rack 420, thus requiring a pull, or a leftward movement of the rack 420, as shown in FIG. 11, for exercise purposes.

While only a single rack and pinion and cable and weight system is shown in FIG. 11, it is obvious that a pair of such apparatus may be secured in parallel to provide for the exercise of both hands, both arms, and both shoulders of a user. Similarly only a single exercise system is shown in FIG. 10. However, obviously a pair of such apparatus may be paired together in parallel to provide exercise for both hands, arms, and shoulders of a user, as has been stated. And, as discussed above for the apparatus 10, any pair of exercise systems may be utilized either singly or together, in parallel, for joint movement, if desired. This is illustrated in FIGS. 12A and 12B.

Figure 12A:
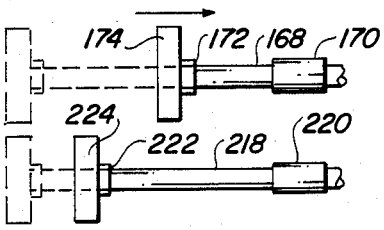
FIG. 12A is a schematic representation of the operation of the present invention.

FIG. 12A is a schematic representation of a portion of the exercise apparatus 10 shown as being not coupled together, and thus acting separately. In FIG. 12B, which is a schematic representation of the same portion of the exercise apparatus, the apparatus is secured together for joint movement.

In FIG. 12A, the sleeves 170 and 220 are shown with the rods 168 and 218 extending respectively through the sleeves. The pads 174 and 224 are in turn secured through the bars 172 and 222 to the rods 168 and 218, respectively. In FIG. 12A, the pad 224 and the rod 218 are shown staggered from, and thus not in parallel alignment with, the pad 174 and the rod 168. The apparatus portions are thus used separately, or oppositely, for alternate movement, and thus for alternate exercising, of the user's upper body muscles.

Figure 12B:
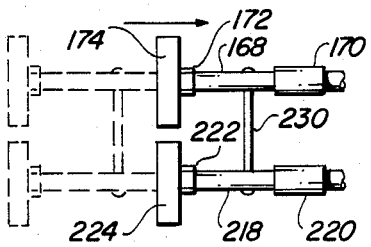
FIG. 12B is a schematic representation of an alternate operation of the apparatus of the present invention.

In FIG. 12B, the rods 168 and 218 are shown secured or locked together by the pin 230. With the pin 230 securing the rods 168 and 218 together, the rods 168 and 218 move jointly, or substantially simultaneously, for the simultaneous exercising of the upper body muscles of the user.

In both FIGS. 12A and 12B, the rest position of the rods and their respective pads is shown in phantom or dotted line, with the solid Figures showing the sequential position of the rods and their pads during the exercise program.

Figure 13A:
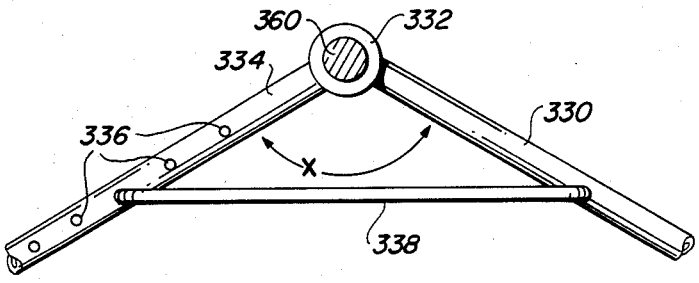
FIG. 13A is a schematic representation of the operation of a portion of the apparatus of the present invention.
Figure 13B:
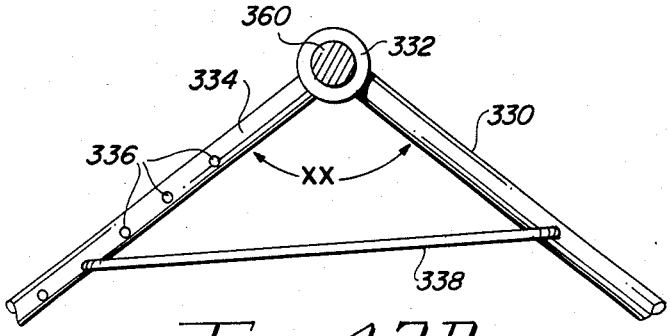
FIG. 13B is a schematic representation of an alternate arrangement of the apparatus shown in FIG. 13A.

FIGS. 12A and 13B are enlarged representations of a portion of the apparatus 300 of FIG. 10, illustrating the securing together of the rods 330 and 334 with different enclosed angles. The enclosed angle between rods 330 and 334 is less in FIG. 13A than it is in FIG. 13B. It will be recalled, as discussed above, that the rods 330 and 334 of the exercise apparatus 300 are, for practical purposes, substantially identical to or the same as the rods 154, 158 and 204, 208 of the exercise apparatus 10 in that they pivot together on a cross rod or cross shaft in response to the horizontal movement of another rod which is moved by a user either through force applied against a pad or force applied to a bar to which the pad is secured. Thus, the illustrations of FIGS. 13A and 13B are also applicable to the apparatus 10 of FIGS. 1–9.

In FIG. 13A, the lock rod 338 is shown extending from the rod 330 to one of the apertures 336 in the shaft 334. The lock rod 338 is secured, in FIG. 13A, to the middle or center of five holes 336 in the rod 334. From viewing the drawings, it will be understood that the closer the lock rod 338 is secured to the cross shaft 360 on which both the rods 330 and 334 pivot, the greater will be the enclosed angle between the two rods. This is so because the length of the lock rod 338 on the rod 330 is fixed, and in order to secure the outer or distal end of the lock rod 338 to the rod 334, the rod 334 and the rod 330 must be moved relative to each other. In order to secure the distal end of the lock rod 338 closer to the pivot point of the rod 334, which is about the shaft 360, the rod 334 must be moved about the shaft 360 outwardly or away from the rod 330.

To decrease the enclosed angle between the rods 330 and 334, the lock rod 338 is moved away from the pivot point of the rod 334 about the shaft 360 and thus to one of the outer holes or apertures 336. As shown in FIG. 13B, the outer or distal end of the lock rod 338 is secured to the fourth aperture 336 from the pivot point about the shaft 360. The enclosed angle is thus decreased.

The effects of lengthening or shortening the enclosed angle between the two rods 330 and 334 may best be understood by reference to FIG. 10 or FIGS. 1 and 2. With the weights, such as the weight 310 or the weights 146, 148 or 196, 198 bottomed out, or in the position of rest, the rods 330 and 154 and 204 will be fixed in place. Movement of the rods 334 and 158 and 208 in response to an adjustment of the lock rods 338 and 162 and 212 will be a movement of the respective rods 334 and 158 and 208 inwardly or outwardly with respect to the "fixed" rods 330 and 154 and 204. This will in turn cause a horizontal movement of the rods 344 and 168 and 218. This occurs, of course, since, if the rods 330 and 154 and 204 are fixed, an adjustment of the rods 334 and 158 and 208 must be accompanied by a corresponding horizontal movement of the horizontal rods 344, 168, and 218 that are secured to the pivotally movable rods 334 and 158 and 208.

The effect, in the final analysis, of either increasing or decreasing the enclosed angle of the pivoting rods by the lock rods will be to increase or decrease, respectively, the length of stroke of the horizontal rods to which the force is applied, either through the pads or through the vertical bars, directly, to which the pads are secured. Thus, by a change in the location at which a lock rod is secured to a pivoting rod, which may be referred to as an intermediate pivoting rod, the length of stroke by a user may be adjusted.

A second effect of the adjustment of the intermediate pivoting rod is that the location of the pad or vertical rod from a user is also varied. However, this second effect is virtually negated by the fact that the back rest is adjustable along the frame. The adjustment of the length of the stroke of the exercise apparatus, together with the adjustment of the back rest, provides a flexibility for the exercise apparatus of the present invention that allows it to accommodate a user of virtually any size, from a relatively small user to a relatively large user.

While the principles of the invention have been made clear in illustrative embodiments, there will be immediately obvious to those skilled in the art many modifications of structure, arrangements, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Horizontal exercise apparatus, comprising, in combination:

frame means, including a first cross member and a second cross member;

horizontal rod means secured to the first cross member of the frame means and movable horizontally in response to force exerted by a user of the apparatus;

pivot rod means secured to the second cross member of the frame means and connected to the horizontal rod means and pivoting on the second cross member of the frame means in response to the horizontal movement of the horizontal rod means including:

a first pivot rod connected to the horizontal rod means and pivotally connected to the frame means for pivoting on the frame means in response to horizontal movement of the horizontal rod means, a second pivot rod pivotally connected to the frame means and connected to the first pivot rod for pivoting on the frame means in response to pivotal movement of the first pivot rod, and lock rod means for adjustably securing together the first and second pivot rods to vary the length of movement of the first horizontal rod; and weight means secured to the frame means and movable vertically in response to the pivoting of the pivot rod means.

2. The apparatus of claim 1 in which the horizontal rod means includes sleeve means secured to the first cross member, and rod means movable through the sleeve means and connected to the pivot rod means for pivoting the pivot rod means.

3. The apparatus of claim 1 in which the rod means includes a first horizontal rod moved horizontally in the sleeve means, and a pad secured to the first horizontal rod and against which a user exerts a force while exercising to move the first horizontal rod.

4. The apparatus of claim 3 in which the weight means includes first weight means connected to the second pivot rod and movable vertically in response to the pivoting movement of the second pivot rod.

5. The apparatus of claim 4 in which the rod means further includes a second horizontal rod disposed substantially parallel to the first horizontal rod and movable horizontally in the sleeve means, and a pad secured to the second horizontal rod and against which a user exerts a force while exercising to move the second horizontal rod.

6. The apparatus of claim 5 in which the horizontal rod means further includes pin means for securing the first and second horizontal rods together for joint movement.

7. The apparatus of claim 6 in which the pin means is removably secured to the first and second horizontal rods so that a user of the apparatus may install the pin means for joint movement of the first and second horizontal rods, and may remove the pin means for separate movement of the first and second horizontal rods.

8. The apparatus of claim 5 in which the pivot rod means further includes a third pivot rod connected to the second horizontal rod and pivotally connected to the frame means for pivoting on the frame means in response to horizontal movement of the second horizontal rod, and a fourth pivot rod pivotally connected to the frame means and connected to the third pivot rod for pivoting on the frame means in response to pivotal movement of the third pivot rod.

9. The apparatus of claim 8 in which the weight means further includes second weight means connected to the fourth pivot rod and movable vertically in response to pivoting movement of the fourth pivot rod.

10. The apparatus of claim 1 in which the frame means includes a back rest against which a user is disposed for moving the horizontal rod means.

11. Horizontal exercise apparatus, comprising, in combination:

frame means;

horizontal rod means secured for horizontal movement to the frame means, including a first horizontal rod having a first end and a second end, a pad secured to the first end, a yoke secured to the second end, and a sleeve pivotally secured to the yoke;

pivot rod means including a first pivoting rod having a first end movable through the sleeve in response to movement of the first horizontal rod and a second end pivotally secured to the frame means, a second pivoting rod having a first end pivotally secured to the frame means and a second end remote from the first end, and a lock rod for securing together the first and second pivoting rods for joint movement in response to horizontal movement of the first horizontal rod; and weight means secured to the frame means and movable vertically in response to the pivoting of the first and second pivoting rods of the pivot rod means.

12. The apparatus of claim 11 in which the weight means includes a weight rod;

weight means secured to the weight rod;

a yoke secured to the weight rod; and a sleeve pivotally secured to the yoke in which the second end of the second pivoting:rod moves for moving the weight rod and the weight means vertically in response to the pivoting of the pivot rod means.

* * * * *